US009957798B2

(12) United States Patent
Su et al.

(10) Patent No.: US 9,957,798 B2
(45) Date of Patent: May 1, 2018

(54) AIR-TIGHT SWITCHING DEVICE FOR USE IN A PNEUMATIC TOOL

(71) Applicant: BASSO INDUSTRY CORP., Taichung (TW)

(72) Inventors: San-Yih Su, Taichung (TW); Da-Jay Lin, Taichung (TW)

(73) Assignee: Basso Industry Corp., Taichung (TW)

( * ) Notice: Subject to any disclaimer, the term of this patent is extended or adjusted under 35 U.S.C. 154(b) by 422 days.

(21) Appl. No.: 14/666,591

(22) Filed: Mar. 24, 2015

(65) Prior Publication Data

US 2015/0275669 A1 Oct. 1, 2015

(30) Foreign Application Priority Data

Mar. 27, 2014 (TW) ..... 103111475 A

(51) Int. Cl.

| | |
|---|---|
| ***F01C 20/14*** | (2006.01) |
| ***F01C 13/02*** | (2006.01) |
| ***B25B 21/00*** | (2006.01) |
| ***B25F 5/00*** | (2006.01) |
| ***B25B 21/02*** | (2006.01) |

(52) U.S. Cl.

CPC ..... *F01C 13/02* (2013.01); *B25B 21/00* (2013.01); *B25B 21/02* (2013.01); *B25F 5/001* (2013.01); *F01C 20/14* (2013.01)

(58) Field of Classification Search

CPC ..... F01C 13/02; F01C 20/04; F01C 20/14

See application file for complete search history.

(56) References Cited

U.S. PATENT DOCUMENTS

| | | | | |
|---|---|---|---|---|
| 4,708,210 | A * | 11/1987 | Rahm | B25B 21/00 173/169 |
| 5,293,747 | A | 3/1994 | Geiger | |
| 6,192,781 | B1 * | 2/2001 | Thames | F15B 13/0406 91/30 |
| 7,886,840 | B2 * | 2/2011 | Young | F01D 15/06 173/168 |
| 2013/0298755 | A1 | 11/2013 | Su et al. | |

FOREIGN PATENT DOCUMENTS

| | | | |
|---|---|---|---|
| CN | 201124361 | Y | 10/2008 |
| GB | 2157213 | A | 10/1985 |
| TW | 201223713 | A1 | 6/2012 |

* cited by examiner

*Primary Examiner* — F. Daniel Lopez

(74) *Attorney, Agent, or Firm* — McNees Wallace & Nurick LLC

(57) ABSTRACT

A switching device for a pneumatic tool includes a valve member, a connecting member and an operating unit. The valve member is rotatable relative to the pneumatic tool between first and second positions. The connecting member is coupled to the valve member in a manner such that the connecting member drives the rotation of the valve member and that an assembly of the valve member and the connecting member is flexible, so as to establish an air-tight seal between the valve member and a pneumatic motor of the pneumatic tool. The operating unit is mounted on the pneumatic tool and coupled co-rotatably to the connecting member.

8 Claims, 7 Drawing Sheets

AIR-TIGHT SWITCHING DEVICE FOR USE IN A PNEUMATIC TOOL

CROSS-REFERENCE TO RELATED APPLICATION

This application claims priority of Taiwanese Application No. 103111475, filed on Mar. 27, 2014.

FIELD

The disclosure relates to a switching device, and more particularly to an air-tight switching device for use in a pneumatic tool.

BACKGROUND

Referring to FIG. 1, U.S. Pat. No. 5,293,747 discloses a conventional pneumatic tool 1 that includes a tool body 11, a pneumatic motor 12, a switching valve 13 and an operating bar 14. The tool body 11 is formed with an air inlet 111 and an air outlet 112. The pneumatic motor 12 is disposed in the tool body 11, and includes a cylinder 123 that defines an air chamber 120 and spaced-apart first and second flow channels 121, 122 communicating fluidly with the air chamber 120, and a rotor 124 that is disposed rotatably in the air chamber 120. The switching valve 13 is formed with a passage 131 and a notch 132, and is switchable between a first state where the passage 131 communicates fluidly the air inlet 111 and the first flow channel 121 and the notch 132 communicates fluidly the second flow channel 122 and the air outlet 112, and a second state where the passage 131 communicates fluidly the air inlet 111 and the second flow channel 122 and the notch 132 communicates fluidly the first flow channel 121 and the air outlet 112. The operating bar 14 is connected to the switching valve 13, extends outwardly from the tool body 11, and is operable to switch the switching valve between the first and second states such that the rotor 124 is rotatable in two opposite rotational directions.

During operation of the conventional pneumatic tool 1, the switching valve 13 needs to contact air-tightly the cylinder 123 by high air pressure of compressed air entering the tool body 11 via the air inlet 111 to ensure the work efficiency of the compressed air. However, since the switching valve 13 is directly connected to the operating bar 14, the switching valve 13 may not be in air-tight contact with the cylinder 123 due to structural interference among the tool body 11, the operating bar 14 and the switching valve 13. Moreover, the switching valve 13 may be moved to generate a gap between the switching valve 13 and the cylinder 123 due to unintended operation or touch of the operating bar 14.

SUMMARY

Therefore, an object of the disclosure is to provide a switching device that can overcome at least one of the aforesaid drawbacks associated with the prior art.

According to the disclosure, the switching device is for use in a pneumatic tool. The pneumatic tool includes a tool body and a pneumatic motor. The tool body includes a handle portion that extends along an X axis, and a head portion that is connected to an end of the handle portion. The handle portion has an inlet flow path that extends along the X axis and that is formed through an opposite end of the handle portion for permitting compressed air to flow thereinto. The pneumatic motor is disposed in the head portion, and includes a cylinder that defines an air chamber, and first and second flow channels communicating fluidly with the air chamber, and a rotor that is disposed rotatably in the air chamber. The switching device includes a valve member, a connecting member and an operating unit. The valve member is disposed in the handle portion, is in contact with the cylinder, and defines an intermediate flow path therethrough. The valve member is rotatable relative to the tool body between a first position where the intermediate flow path communicates fluidly the inlet flow path and the first flow channel, and a second position where the intermediate flow path communicates fluidly the inlet flow path and the second flow channel, such that the rotor is rotatable in two opposite directions. The connecting member is disposed in the handle portion, and is coupled to an end of the valve member opposite to the pneumatic motor in a manner such that the connecting member drives the rotation of the valve member between the first and second positions and that an assembly of the valve member and the connecting member is flexible, so as to establish an air-tight seal between the valve member and the cylinder. The operating unit is mounted operably on the handle portion and coupled co-rotatably to the connecting member.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
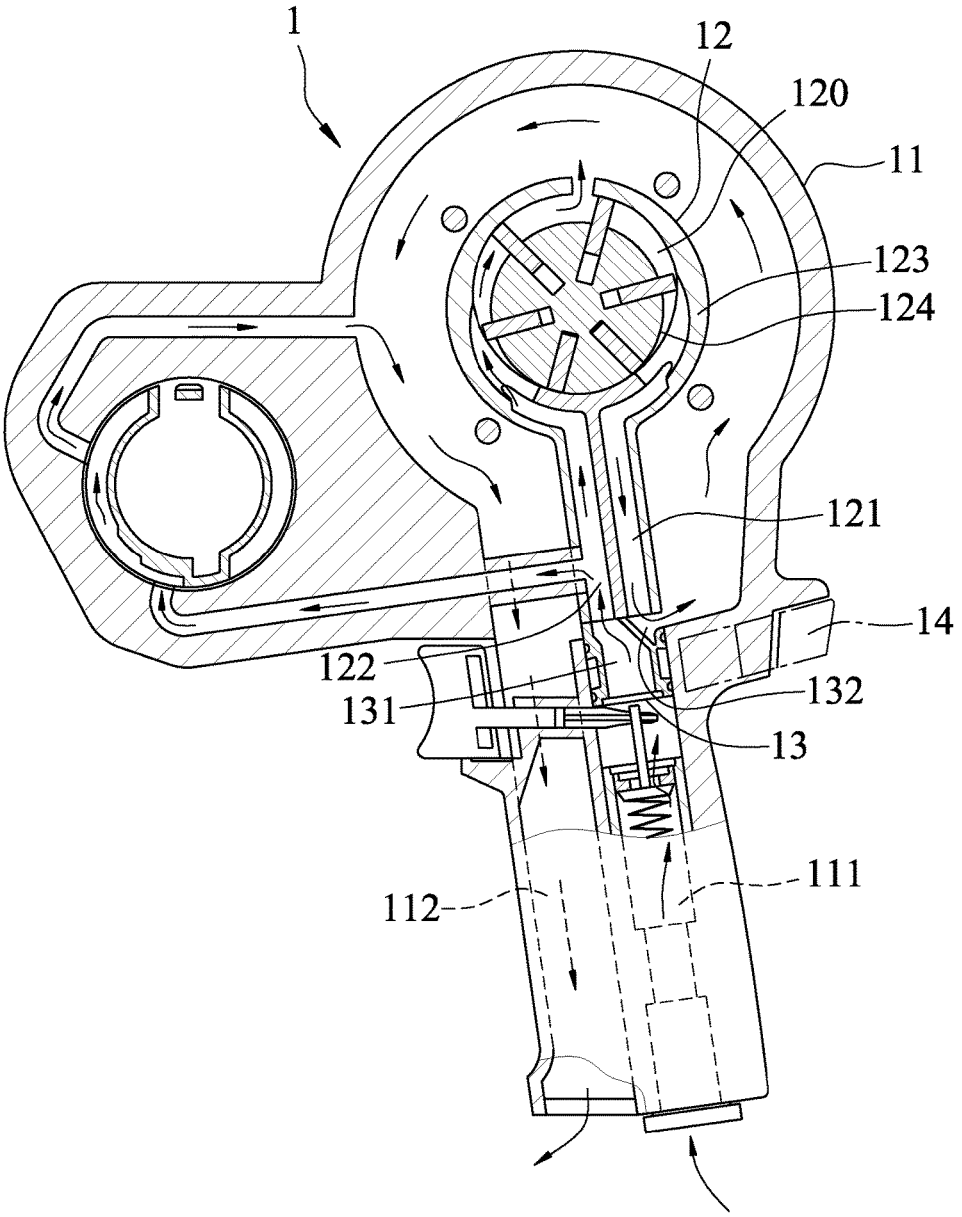
FIG.1 PRIOR ART
FIG. 1 is a partly sectional view of a conventional pneumatic tool of U.S. Pat. No. 5,293,747.
Figure 2:
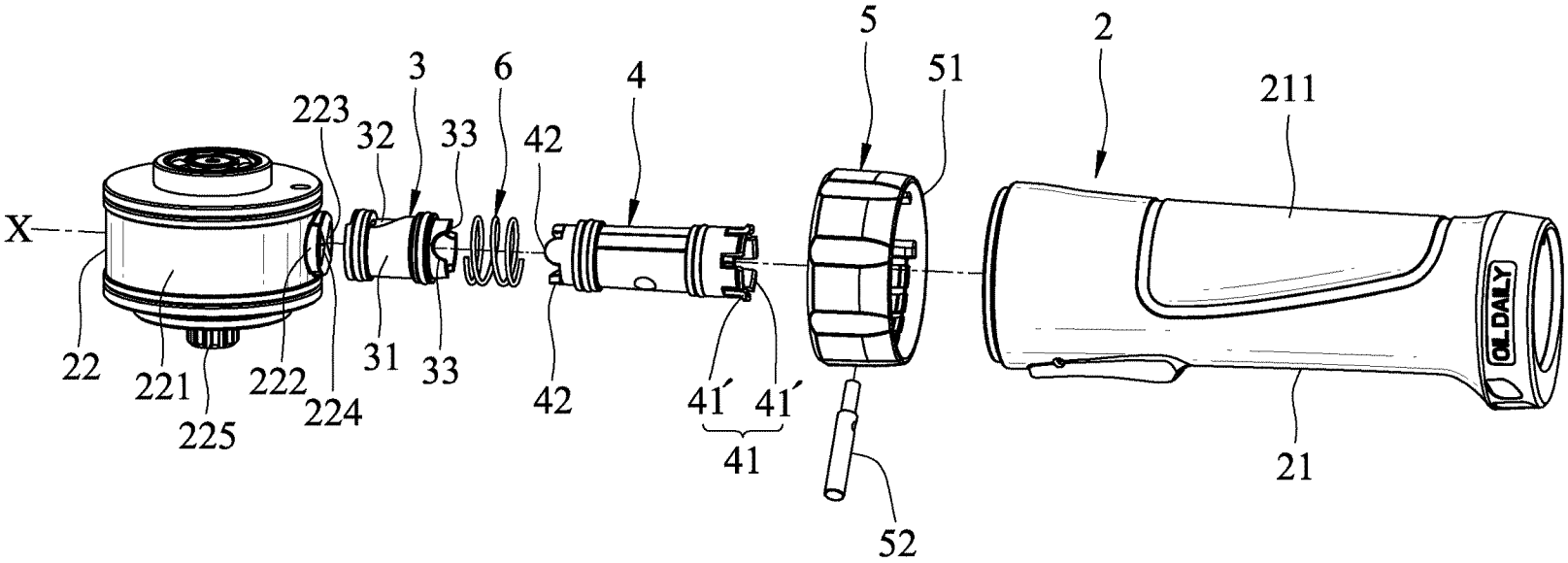
FIG. 2 is an exploded perspective view of a pneumatic tool including a first embodiment of a switching device according to the disclosure.
Figure 3:
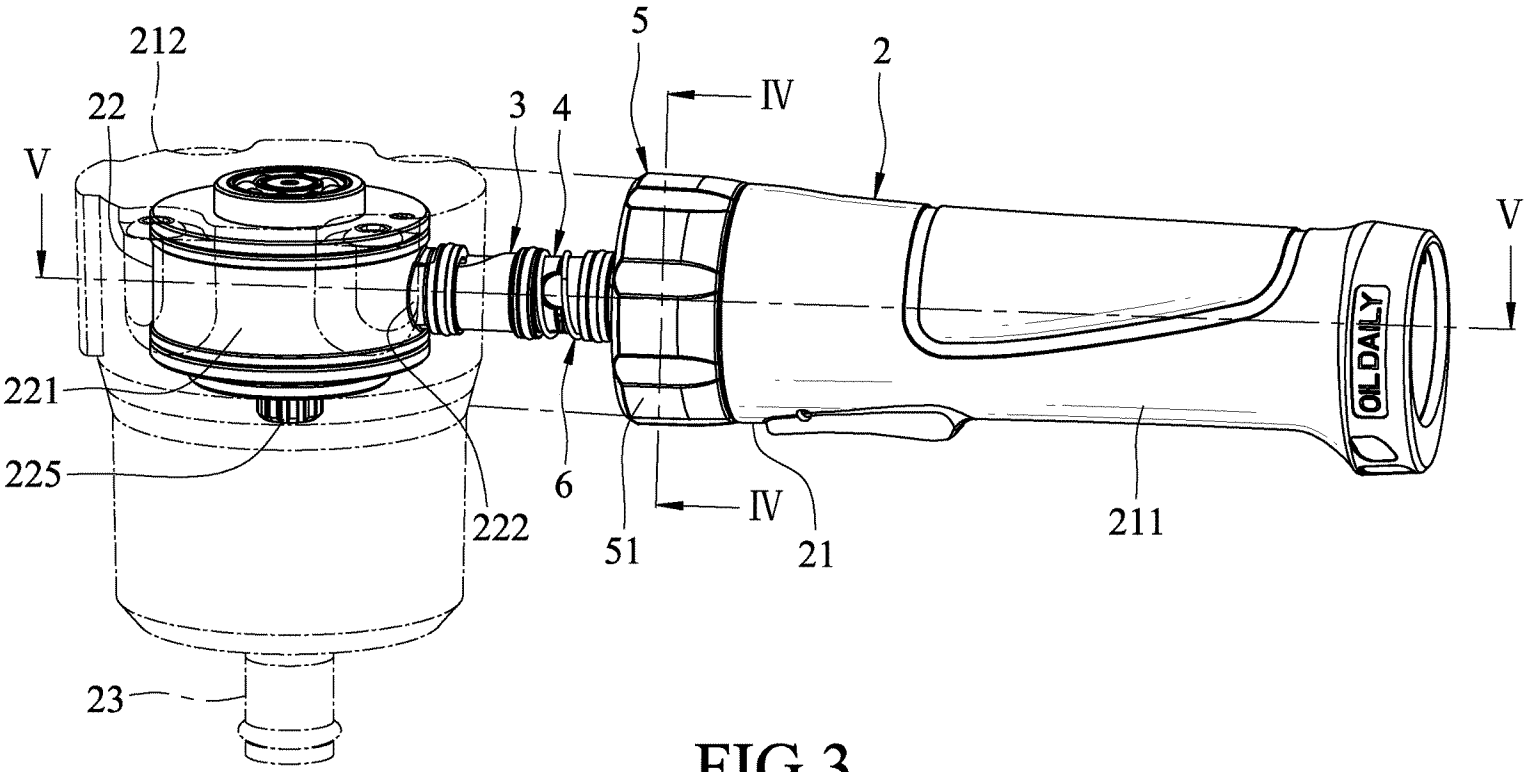
FIG. 3 is an assembled perspective view of the pneumatic tool.
Figure 4:
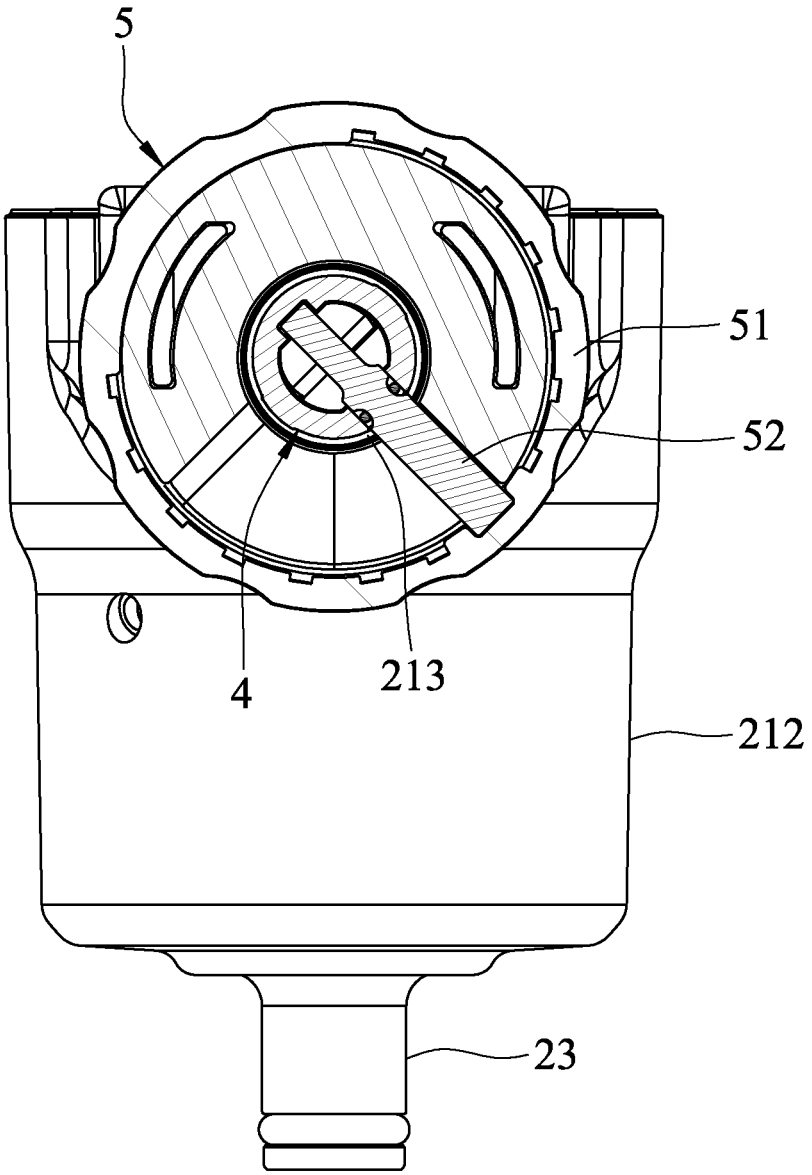
FIG. 4 is a sectional view of the pneumatic tool taken along line IV-IV in FIG. 3.
Figure 5:
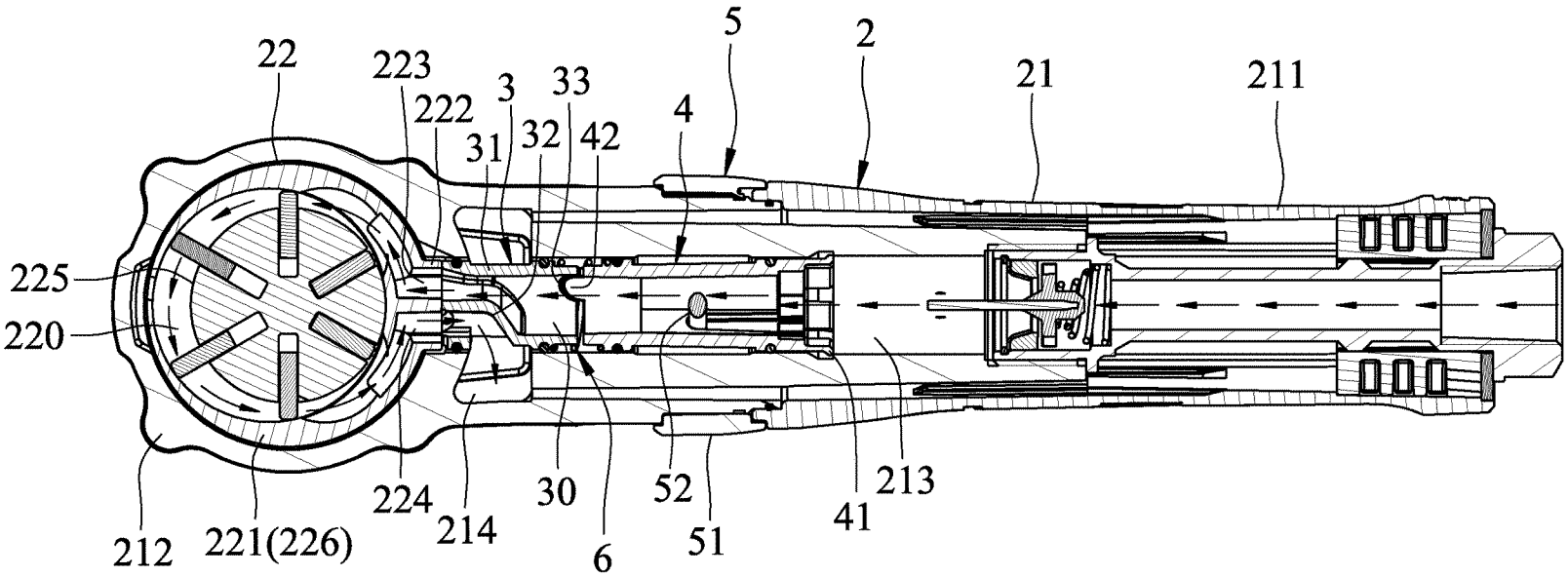
FIG. 5 is a sectional view of the pneumatic tool taken along line V-V in FIG. 3.

Before the disclosure is described in greater detail, it should be noted that like elements are denoted by the same reference numerals throughout the disclosure.

Referring to FIGS. 2 to 5, a first embodiment of a switching device according to the disclosure is for use in a pneumatic tool 2. The pneumatic tool 2 includes a tool body 21, a pneumatic motor 22 and a hammer unit 23. The tool body 21 includes a handle portion 211 that extends along an X axis (X), and a head portion 212 that is connected to an end of the handle portion 211. The handle portion 211 has an inlet flow path 213 that extends along the X axis (X) and that is formed through an opposite end of the handle portion 211 for permitting compressed air to flow thereinto, and an outlet flow path 214 for expelling expanded air from the pneumatic tool 2. The pneumatic motor 22 is disposed in the head portion 212, and includes a cylinder 221 and a rotor 225. The cylinder 221 has a cylinder body 226 that defines an air chamber 220 therein, a tube section 222 that surrounds the X axis (X) and that is connected to a side portion of the cylinder body 226, and spaced-apart first and second flow channels 223, 224 that are formed through the tube section 222 and that extend from the tube section 222 into the air chamber 220 along a periphery of the cylinder body 226 in opposite directions (i.e., clockwise and counterclockwise directions). The rotor 225 is disposed rotatably in the air chamber 220. The hammer unit 23 is connected co-rotatably to the rotor 225. The switching device includes a valve member 3, a connecting member 4, an operating unit 5 and a resilient member 6.

Figure 6:
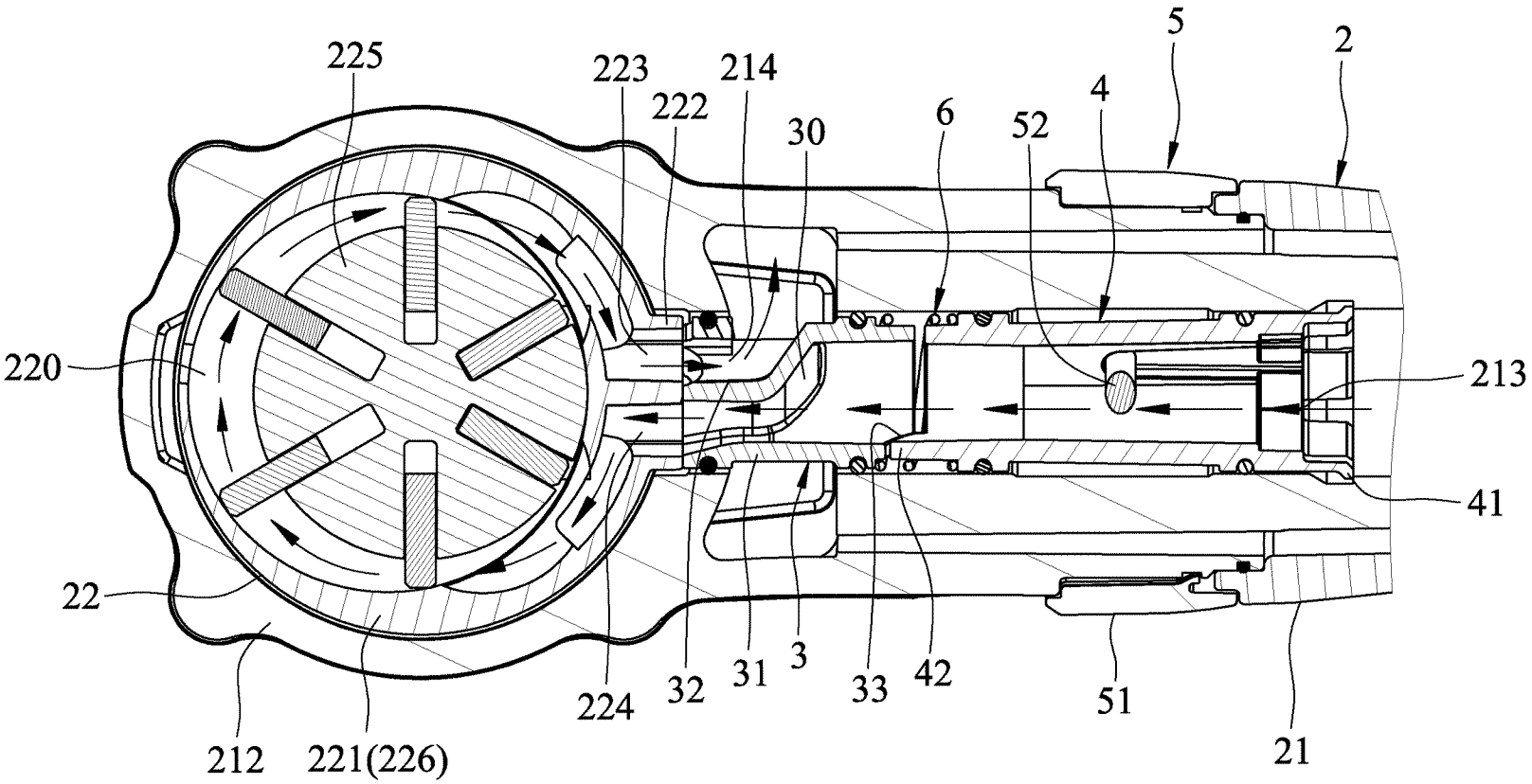
FIG. 6 is an enlarged fragmentary sectional view of the pneumatic tool.

The valve member 3 is disposed in the handle portion 211, is in contact with the tube section 222 of the cylinder 221, and has a valve body 31, an intermediate flow path 30 that is formed through the valve body 31, an intermediate groove 32 that is formed in an outer surface of the valve body 31, and a transmission structure 33 that is provided on an end of the valve body 31 opposite to the cylinder 221. The valve member 3 is rotatable relative to the tool body 21 about the X axis (X) between a first position (see FIG. 5) where the intermediate flow path 30 communicates fluidly the inlet flow path 213 and the first flow channel 223 and the intermediate groove 32 communicates fluidly the second flow channel 224 and the outlet flow path 214, and a second position (see FIG. 6) where the intermediate flow path 30 communicates fluidly the inlet flow path 213 and the second flow channel 224 and the intermediate groove 32 communicates fluidly the first flow channel 223 and the outlet flow path 214. In this embodiment, the transmission structure 33 is configured as a plurality of recesses that surround the X axis (X). However, in a variation of this embodiment, the transmission structure 33 may be configured as a plurality of protrusions.

The connecting member 4 is disposed in the handle portion 211, and is rotatable relative to the tool body 21 about the X axis (X). The connecting member 4 has a transmission structure 42 that is provided at an end thereof and that is coupled to the transmission structure 33 of the valve member 3, and a split coupling flange unit 41 that is provided at an opposite end thereof distal from the valve member 3. The coupling flange unit 41 is coupled to the handle portion 211 such that the connecting member 4 is prevented from moving along the X axis (X) relative to the handle portion 211. To be more specific, the coupling flange unit 41 includes a plurality of resilient barbs 41' hooked into the handle portion 211. In this embodiment, the transmission structure 42 is configured as a plurality of protrusions that surround the X axis (X), and that engage the transmission structure 33 of the valve member 3. However, in the variation of this embodiment, the transmission structure 42 is configured as a plurality of recesses. The transmission structures 33, 42 of the valve member 3 and the connecting member 4 are coupled in a manner such that the connecting member 4 drives the rotation of the valve member 3 between the first and second positions and that an assembly of the valve member 3 and the connecting member 4 is flexible. In this embodiment, an intentional gap occurs between each of the protrusions and a wall defining the corresponding recess.

The operating unit 5 includes an annular operating member 51 that is sleeved rotatably on the handle portion 211, and a linking member 52 that interconnects co-rotatably the operating member 51 and the connecting member 4, such that the operating unit 5 is operable to rotate the valve member 3 between the first and second positions.

The resilient member 6 has opposite ends abutting respectively against the valve member 3 and the connecting member 4 for biasing resiliently the valve member 3 to contact the tube section 222 of the cylinder 221.

When the compressed air flows into the intermediate flow path 30 via the inlet flow path 213, high air pressure of the compressed air pushes the valve member 3 to move toward the tube section 222 of the cylinder 221. Since the assembly of the valve member 3 and the connecting member 4 is flexible, the valve member 3 and the tube section 222 are in air-tight contact with each other regardless of structural interference among the valve member 3, the connecting member 4 and the operating unit 5. The resilient member 6 further enhances the air-tight seal between the valve member 3 and the tube section 222.

By rotating the operating member 51 of the operating unit 5, the valve member 3 is switchable between the first and second positions such that the rotor 225 is rotatable in two opposite directions. The working principle of the pneumatic motor 22 is well-known in the art, and will not be explained hereinafter.

Figure 7:
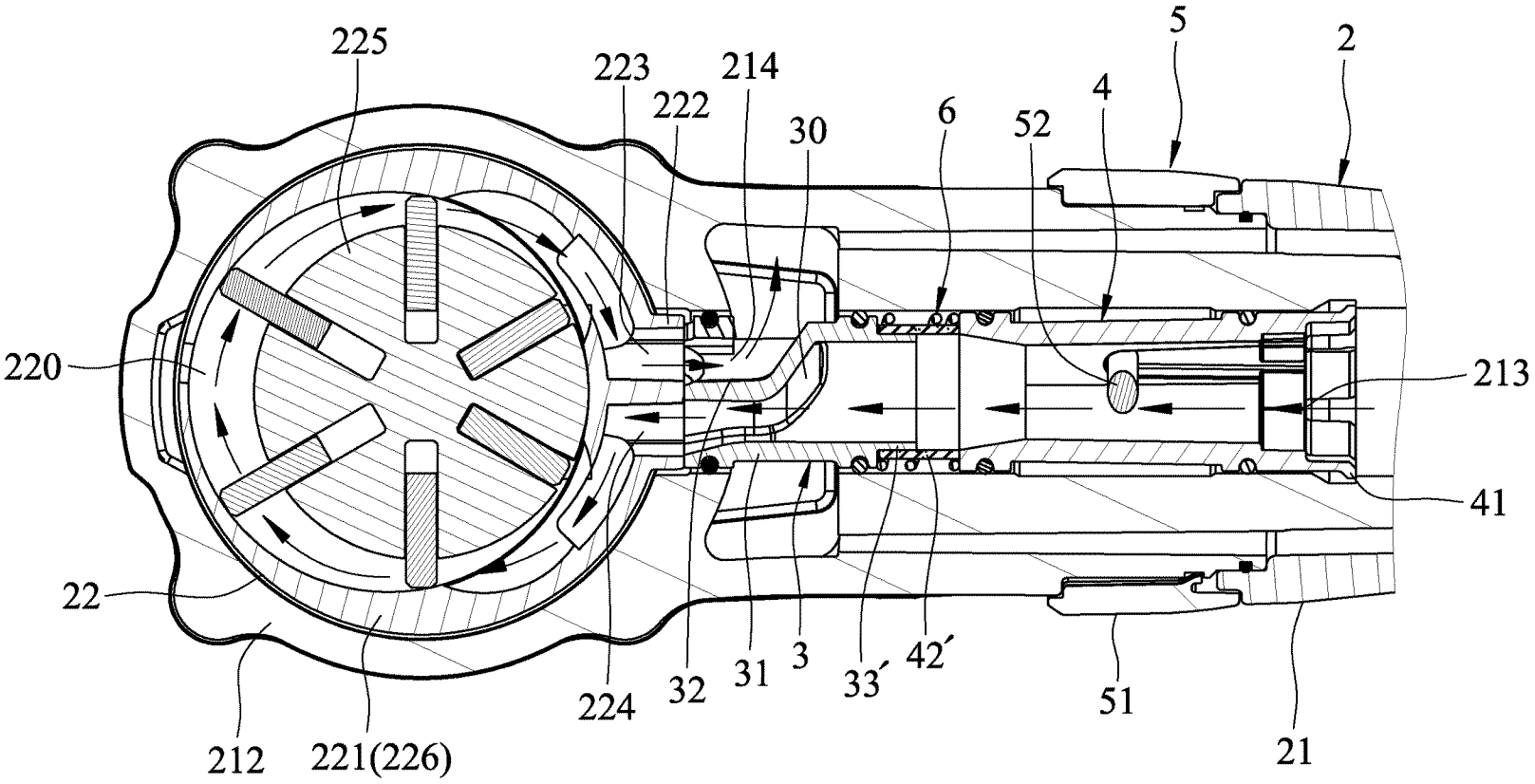
FIG. 7 is an enlarged fragmentary sectional view of a pneumatic tool including a second embodiment of the switching device according to the disclosure.

Referring to FIG. 7, a second embodiment of the switching device according to the disclosure is similar to the first embodiment. In the second embodiment, the transmission structure 33' of the valve member 3 is configured to be tubular and surrounds the X axis (X), and the transmission structure 42' of the connecting member 4 is configured as a flexible sleeve that surrounds the X axis (X) and that permits the transmission structure 33' of the valve member 3 to be press fitted thereinto for allowing rotation transmission between the valve member 3 and the connecting member 4.

The advantages of this disclosure are as follows:

1. Since the assembly of the valve member 3 and the connecting member 4 is flexible, the valve member 3 and the tube section 222 are in air-tight contact with each other even when the operating member 51 of the operating unit 5 is touched unintendedly. Therefore, the work efficiency of the compressed air is enhanced.

2. By virtue of the resilient member 6, the valve member 3 and the tube section 222 can be in air-tight contact with each other even though the compressed air does not flow into the intermediate flow path 30.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A switching device adapted for use in a pneumatic tool, the pneumatic tool including a tool body and a pneumatic motor, the tool body including a handle portion that extends along an X axis, and a head portion that is connected to an end of the handle portion, the handle portion having an inlet flow path that extends along the X axis and that is formed through an opposite end of the handle portion for permitting compressed air to flow thereinto, the pneumatic motor being disposed in the head portion, and including a cylinder that defines an air chamber, and first and second flow channels communicating fluidly with the air chamber, and a rotor that is disposed rotatably in the air chamber, said switching device comprising:

a valve member adapted to be disposed in the handle portion, being in contact with the cylinder, and defining an intermediate flow path therethrough, said valve member being rotatable relative to the tool body between a first position where said intermediate flow path communicates fluidly the inlet flow path and the first flow channel, and a second position where said intermediate flow path communicates fluidly the inlet flow path and the second flow channel, such that the rotor is rotatable in two opposite directions;

a connecting member adapted to be disposed in the handle portion, and coupled to an end of said valve member opposite to the pneumatic motor along the X axis in a manner such that said connecting member drives the rotation of said valve member between the first and second positions and that an assembly of said valve member and said connecting member is flexible, so as to establish an air-tight seal between said valve member and the pneumatic motor;

an operating unit adapted to be mounted operably on the handle portion and coupled co-rotatably to said connecting member; and a resilient member having opposite ends abutting respectively against said valve member and said connecting member for biasing resiliently said valve member to contact the pneumatic motor.

2. The switching device as claimed in claim 1, wherein said valve member further has a transmission structure provided at said end thereof opposite to the pneumatic motor, said connecting member having a transmission structure that is coupled to said transmission structure of said valve member, such that rotation is transmitted from said connecting member to said valve member.

3. The switching device as claimed in claim 2, wherein said connecting member is adapted to be disposed rotatably in the inlet flow path, and is not movable along the X axis.

4. The switching device as claimed in claim 2, wherein said transmission structure of said valve member is configured as one of a protrusion and a recess, said transmission structure of said connecting member being configured as the other one of said protrusion and said recess, and engaging said transmission structure of said valve member, such that flexation of said valve member relative to said connecting member is allowed.

5. The switching device as claimed in claim 1, wherein said connecting member has a split coupling flange unit that is disposed at an end thereof distal from said valve member and that is adapted to be coupled to the handle portion such that said connecting member is prevented from moving along the X axis relative to the handle portion.

6. The switching device as claimed in claim 1, wherein said operating unit includes an annular operating member that is adapted to be sleeved rotatably on the handle portion, and a linking member that interconnects co-rotatably said operating member and said connecting member.

7. The switching device as claimed in claim 1, the handle portion further having an outlet flow path, wherein said valve member further has an intermediate groove that is formed in an outer surface thereof, said intermediate groove being adapted to be in fluid communication with the second flow channel and the outlet flow path when said valve member is at the first position, and with the first flow channel and the outlet flow path when said valve member is at the second position, so as to guide expanded air in the air chamber to be expelled from the pneumatic tool.

8. A switching device adapted for use in a pneumatic tool, the pneumatic tool including a tool body and a pneumatic motor, the tool body including a handle portion that extends along an X axis, and a head portion that is connected to an end of the handle portion, the handle portion having an inlet flow path that extends along the X axis and that is formed through an opposite end of the handle portion for permitting compressed air to flow thereinto, the pneumatic motor being disposed in the head portion, and including a cylinder that defines an air chamber, and first and second flow channels communicating fluidly with the air chamber, and a rotor that is disposed rotatably in the air chamber, said switching device comprising:

a valve member adapted to be disposed in the handle portion, being in contact with the cylinder, and defining an intermediate flow path therethrough, said valve member being rotatable relative to the tool body between a first position where said intermediate flow path communicates fluidly the inlet flow path and the first flow channel, and a second position where said intermediate flow path communicates fluidly the inlet flow path and the second flow channel, such that the rotor is rotatable in two opposite directions;

a connecting member adapted to be disposed in the handle portion, and coupled to an end of said valve member opposite to the pneumatic motor along the X axis in a manner such that said connecting member drives the rotation of said valve member between the first and second positions and that an assembly of said valve member and said connecting member is flexible, so as to establish an air-tight seal between said valve member and the pneumatic motor;

an operating unit adapted to be mounted operably on the handle portion and coupled co-rotatably to said connecting member;

wherein said valve member further has a transmission structure provided at said end thereof opposite to the pneumatic motor, said connecting member having a transmission structure that is coupled to said transmission structure of said valve member, such that rotation is transmitted from said connecting member to said valve member; and wherein said transmission structure of said valve member is configured to be tubular, said transmission structure of said connecting member being configured as a flexible sleeve that permits said transmission structure of said valve member to be press fitted thereinto for allowing rotation transmission between said valve member and said connecting member.

* * * * *